US012419404B2

(12) United States Patent
Gardet et al.

(10) Patent No.: US 12,419,404 B2
(45) Date of Patent: Sep. 23, 2025

(54) COSMETIC PRODUCT PACKAGING DEVICE

(71) Applicant: L'OREAL, Paris (FR)

(72) Inventors: Pierre Gardet, Clichy (FR); Emeric Renaudin, Clichy (FR)

(73) Assignee: L'Oreal, Paris (FR)

( * ) Notice: Subject to any disclaimer, the term of this patent is extended or adjusted under 35 U.S.C. 154(b) by 101 days.

(21) Appl. No.: 17/995,906

(22) PCT Filed: Apr. 21, 2021

(86) PCT No.: PCT/EP2021/060334
§ 371 (c)(1),
(2) Date: Oct. 10, 2022

(87) PCT Pub. No.: WO2021/214113
PCT Pub. Date: Oct. 28, 2021

(65) Prior Publication Data

US 2023/0218060 A1 Jul. 13, 2023

(30) Foreign Application Priority Data

Apr. 24, 2020 (FR) ..... 2004117

(51) Int. Cl.
*A45D 33/00* (2006.01)

(52) U.S. Cl.
CPC ..... *A45D 33/003* (2013.01); *A45D 2200/05* (2013.01)

(58) Field of Classification Search
CPC .. A45D 33/003; A45D 2200/05; A45D 33/00; A45D 34/00; A45D 40/00
See application file for complete search history.

(56) References Cited

U.S. PATENT DOCUMENTS 5,092,354 A * 3/1992 Pacelli, Jr. ..... A45D 40/22 206/823
5,605,167 A * 2/1997 Montoli ..... A45C 13/02 132/294

(Continued)

FOREIGN PATENT DOCUMENTS

CN 101753053 A 6/2010
CN 111017398 A 4/2020

(Continued)

OTHER PUBLICATIONS

International Search and Written Opinion as mailed on Dec. 5, 2021, issued in corresponding International Application No. PCT/EP2021/060334, filed Apr. 21, 2021, 10 pages.

(Continued)

*Primary Examiner* — James N Smalley
(74) *Attorney, Agent, or Firm* — CHRISTENSEN O'CONNOR JOHNSON KINDNESS PLLC

(57) ABSTRACT

Device for packaging a product, in particular a cosmetic product, comprising a receptacle extending along an elevation axis (Z-Z') and comprising an internal volume delimited by a lower wall and a peripheral wall; a lid that is hinged with respect to said receptacle; and a support member that is mounted in the internal cavity of the receptacle and is intended to receive at least one cosmetic product, the support member comprising an internal volume delimited by a bottom wall and a peripheral wall.
The support member comprises at least one stiffening member (38) surrounded by the peripheral protrusion, said stiffening member extending along the elevation axis (Z-Z') from the bottom wall of the support member towards the lower wall (12) of the receptacle and being secured to said lower wall.

16 Claims, 7 Drawing Sheets

(56) References Cited

U.S. PATENT DOCUMENTS

| | | | | |
|---|---|---|---|---|
| 9,167,879 | B2 * | 10/2015 | Gatesoupe | A45D 40/261 |
| 2015/0251104 | A1 * | 9/2015 | Lange | A63H 33/046 446/92 |

FOREIGN PATENT DOCUMENTS

| | | | |
|---|---|---|---|
| EP | 2 537 434 | A1 | 12/2012 |
| FR | 2 534 787 | A1 | 4/1984 |
| WO | 2012/120066 | A1 | 9/2012 |

OTHER PUBLICATIONS

First Chinese Office Action mailed Feb. 28, 2025, issued in corresponding Chinese Patent Application No. 202180027347.3, filed Oct. 9, 2022, 16 pages.

* cited by examiner

COSMETIC PRODUCT PACKAGING DEVICE

CROSS-REFERENCES TO RELATED APPLICATIONS

This application is a National Stage of International Application No. PCT/EP2021/060334 filed Apr. 21, 2021, which claims the benefit of French Application No. 2004117, filed Apr. 24, 2020, the disclosure of which is incorporated herein in their entirety.

The present invention relates to the field of the packaging of cosmetic products.

The term "cosmetic product" is understood, notably within the meaning of the present invention, to mean a product as defined in Regulation (EC) No 1223/2009 of the European Parliament and of the Council of 30 Nov. 2009 relating to cosmetic products.

More particularly, the packaging and dispensing assembly according to the present invention is intended for dispensing a cosmetic product such as, for example, an anhydrous product, in the form of compact powder, intended to be applied, for example, to the user's epidermis.

Such a cosmetic product packaging assembly may, for example, be in the form of a case comprising a receptacle delimiting an internal cavity, and a lid that is hinged to said receptacle between a position closing said case, in which it cooperates with the receptacle to close the internal cavity, and a position opening the case, in which it is spaced apart from the receptacle to free up access to the internal cavity.

It is known practice to equip such a packaging assembly with a support member intended to receive at least one cosmetic product. The support member is mounted in the internal cavity of the receptacle and forms an insert arranged in the latter. Such a design comprising a receptacle and a support member that are separate from one another makes it possible to use two different materials for these elements, such that the receptacle/support member assembly can provide the mechanical and aesthetic functions for which it is intended, while having an optimal manufacturing cost.

The known product packaging assemblies are not entirely satisfactory in terms of weight.

Therefore, there is a need to provide a device for packaging a cosmetic product that is lighter than the known packaging devices while maintaining satisfactory stiffness of the device.

Specifically, making cosmetic product packaging devices lighter is an essential concern during the design thereof, both in order to reduce the amount of material, in particular plastics material, used to make the device, thereby reducing its manufacturing cost, but also the resources and energy necessary for the manufacture, transport and recyclability thereof, thereby also responding to an issue of reducing the ecological impact thereof during the lifetime thereof.

However, this objective has to be reconciled with the need to ensure integrity and structural stiffness of these new-generation cosmetic product packaging devices, at least equivalent to those of the previous generation.

A subject of the invention is a device for packaging a product, in particular a cosmetic product, comprising:

- a receptacle extending along an elevation axis and comprising an internal volume delimited by a lower wall and a peripheral wall;
- a lid that is hinged with respect to said receptacle between a closing position, in which said lid cooperates with the receptacle and closes off access to the internal volume of said receptacle, and an opening position, in which said lid is pivoted away from the receptacle to allow access to said internal volume; and
- a support member that is mounted in the internal cavity of the receptacle and is intended to receive at least one cosmetic product, the support member comprising an internal volume delimited by a bottom wall and a peripheral wall.

One of the support member or the receptacle also comprises at least one stiffening member that extends along the elevation axis from one of the support member or the receptacle towards the other of the support member or the receptacle and is secured to the other of the support member or the receptacle.

In other words, either the support member comprises the stiffening member extending towards the receptacle, or it is the receptacle that comprises the stiffening member extending towards the support member.

By virtue of the stiffening member, it is possible to significantly reduce the thicknesses in particular of the support member and/or of the receptacle, but more particularly of the receptacle when the stiffening member is secured to the support member, and thus the weight and the amount of material used to make the product packaging device, while maintaining constant stiffness of the assembly formed by the receptacle and the support member.

The weight saving observed is between 15% and 40% compared with a packaging device that does not have a stiffening member between the product support member and the receptacle.

One of the support member or the receptacle comprises an at least partially peripheral protrusion that extends along the elevation axis towards the other of the support member or the receptacle and is secured to the other of the support member or the receptacle.

In other words, the support member may comprise the peripheral protrusion extending towards the receptacle, or the receptacle may comprise the peripheral protrusion extending towards the support member.

Provision could also be made for the support member to comprise the peripheral protrusion and for the receptacle to comprise the stiffening member, or vice versa.

For example, the stiffening member is surrounded by the peripheral protrusion.

According to one embodiment, the support member comprises the at least partially peripheral protrusion that extends along the elevation axis in the continuation of the peripheral wall towards the lower wall of the receptacle and is secured to said lower wall, in particular the upper surface thereof, and the stiffening member surrounded by the peripheral protrusion. Said stiffening member extends along the elevation axis from the bottom wall of the support member towards the lower wall of the receptacle and is secured to said lower wall. In this way, a mechanical connection is obtained between said support member and said receptacle.

The support member is thus secured to the receptacle by the creation of a mechanical connection between its at least partially peripheral protrusion and its at least one stiffening member, which are in particular formed integrally with its bottom wall, and the lower wall of the receptacle.

The fact that the peripheral protrusion and the stiffening member are provided on the support member makes it possible to avoid the formation of shrinkage marks that are liable to appear at the junction of two, in particular orthogonal, segments of an injection-moulded plastics part, on a visible part of the device, that is to say a part that can be seen from the outside of the device. These possible shrinkage marks are thus shifted onto the support member, and more specifically onto the upper face thereof, which is intended to be hidden from the user, and not onto the receptacle, for which it is preferable to have a high-quality external appearance.

Furthermore, in such a configuration, the saving in mass obtained in the assembly formed by the support member and the receptacle is realized mainly in the receptacle, the constituent material of which is of higher quality than that of the support member and the density of which is often higher. This results in an economic saving and an ecological improvement.

Advantageously, the stiffening member and/or the at least partially peripheral protrusion is/are formed integrally with the support member. In other words, the stiffening member and/or the at least partially peripheral protrusion and the support member form a single part produced during a moulding step.

For example, the stiffening member is fixed to the receptacle by ultrasonic welding. As a variant, any other fixing means could be provided, such as adhesive bonding or laser welding, for example.

For example, the peripheral protrusion is fixed to the receptacle by ultrasonic welding. As a variant, any other fixing means could be provided, such as adhesive bonding or laser welding, for example.

According to one embodiment, the stiffening member comprises at least one central protrusion.

For example, the central protrusion has a closed or open contour.

According to one embodiment, the stiffening member comprises at least one radial protrusion.

The radial protrusion is, for example, disposed between the central protrusion and the peripheral protrusion. A plurality of radial protrusions could be provided, for example in a manner spaced apart regularly or irregularly around the central protrusion. As a variant, a different disposition of the radial protrusions around the central protrusion could be provided. As illustrated, the number of radial protrusions is equal to twelve. As a variant, a different number of radial protrusions, for example more than two, could be provided. Provision could be made for the radial protrusions all to have identical or different dimensions.

According to one embodiment, the stiffening member comprises at least one intermediate protrusion disposed between the central protrusion and the peripheral protrusion.

According to one embodiment, the stiffening member comprises at least one radial protrusion between the central protrusion and the intermediate protrusion and/or at least one radial protrusion between the intermediate protrusion and the peripheral protrusion.

The intermediate protrusion may be concentric with the central protrusion.

The intermediate protrusion has a closed or open contour. As a variant, an intermediate protrusion with a closed contour could be provided. As a variant, an intermediate protrusion with a contour identical to the contour of the central protrusion could be provided.

Advantageously, the lower wall of the receptacle has a thickness of between 0.5 mm and 0.9 mm, for example equal to 0.7 mm.

For example, the bottom wall of the support member comprises a thickness of between 0.65 mm and 0.75 mm, for example equal to 0.7 mm.

For example, the peripheral wall of the receptacle has a thickness of between 0.75 mm and 0.85 mm, for example equal to 0.82 mm.

For example, the internal volume of the support member is intended to receive a dish comprising at least one compartment of cosmetic product. As a variant, provision could be made for the cosmetic product(s) to be contained directly in the support member.

The support member may comprise an upper rim or bearing flange protruding radially from the upper surface of the peripheral wall of said support member.

For example, the support member also comprises positioning ribs protruding along the elevation axis from the lower surface of the rim towards the receptacle.

Further aims, features and advantages of the invention will become apparent from reading the following description, which is given only by way of non-limiting example and with reference to the appended drawings, in which.

FIG. 13 and

Figure 14:
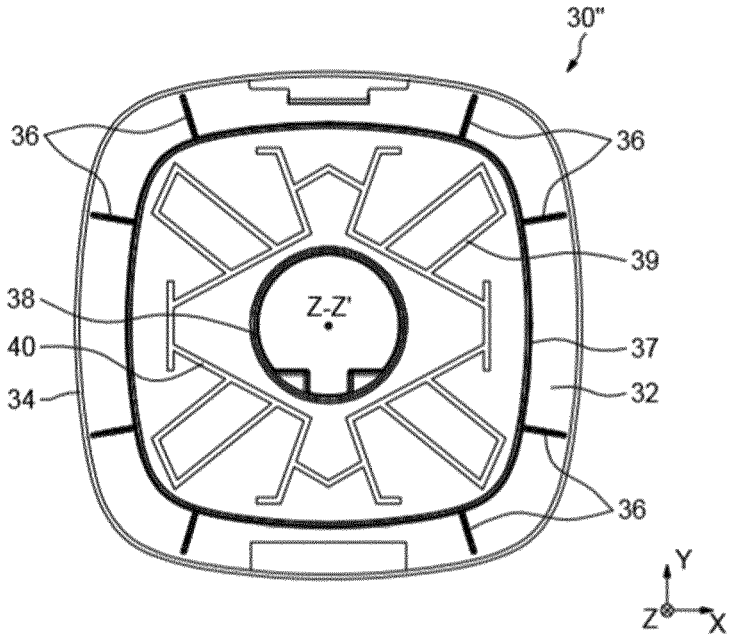

FIG. 14 illustrate bottom views of a support member according to two other embodiments.

A device 1 for packaging a product is illustrated in FIGS. 1 to 4.

A "product" means a cosmetic product such as, for example, a finely ground, compacted solid product, in the form of compact powder, that is intended to be applied, for example, to the user's epidermis. The compact powder may be of the foundation, face powder or eyeshadow type that is picked up, for example, directly with the finger or with a powder puff or with a brush.

In the rest of the description, reference will be made to an orthonormal basis X, Y, Z, where Z corresponds to an elevation axis representing the vertical direction. The median section plane M in FIGS. 2 and 3 is a plane (Y, Z) of symmetry of the receptacle 10.

Figure 2:
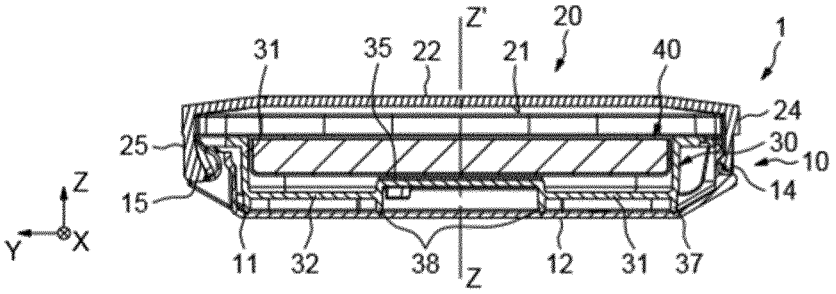
FIG. 2 is a view in cross section on a median plane M of the device in FIG. 1, in which the lid is in a closed position.
Figure 3:
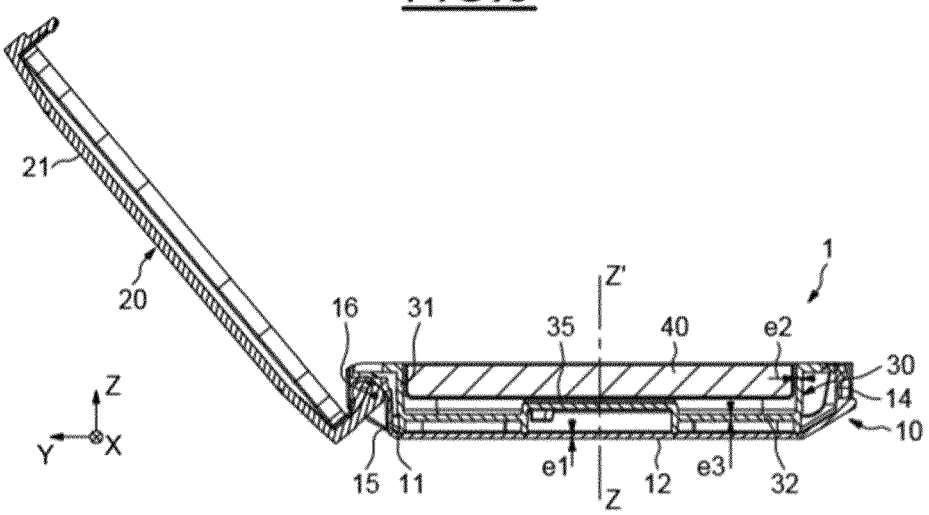
FIG. 3 shows a view in cross section of the device in FIG. 1, in which the lid is in an open position.
Figure 4:
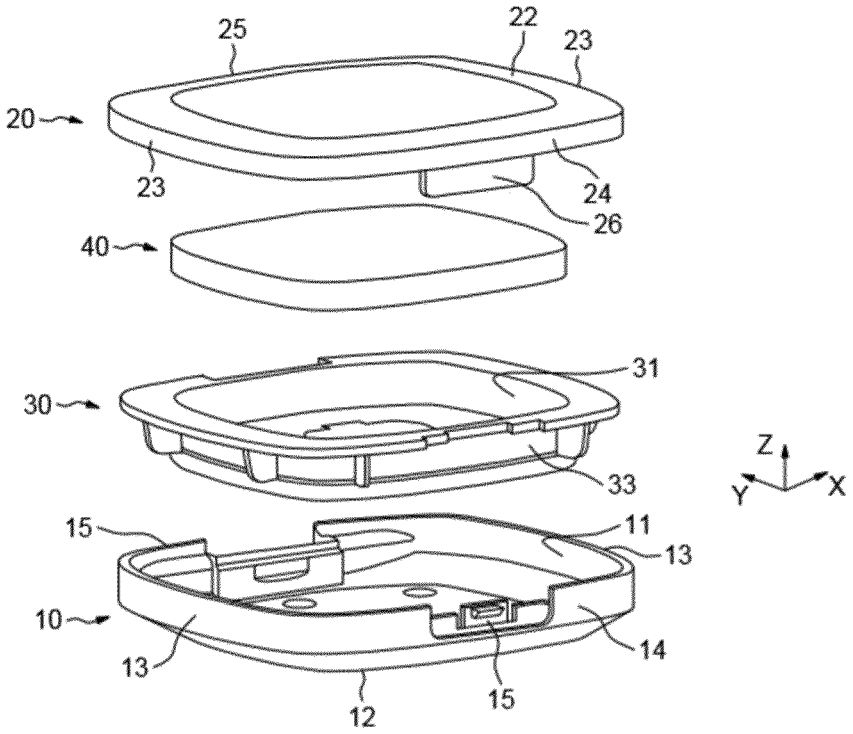
FIG. 4 is an exploded perspective view of the device in FIG. 1.
Figure 5:
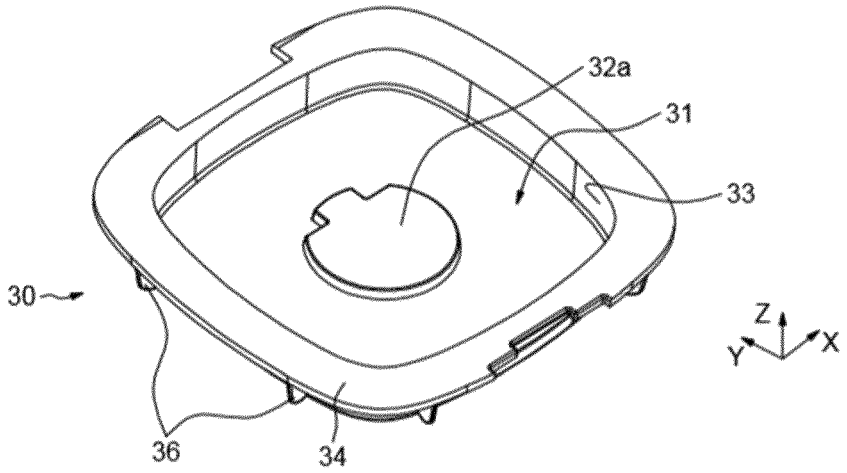
FIG. 5 is a perspective view of a support member of the device in FIG. 1.

The device 1 is of the makeup case type and comprises a receptacle 10, a lid 20 that is hinged with respect to said receptacle 10 between a closing position, visible in FIG. 2, and an opening position, visible in FIG. 3, and a support member 30 intended to receive at least one cosmetic product.

The receptacle 10 comprises a body with a parallelepipedal overall shape extending along an elevation axis Z-Z' that is presumed to be vertical in the figures. Any other shape could be provided for the body, for example cylindrical.

The body of the receptacle 10 comprises an internal volume 11 for receiving a cosmetic article. The internal volume 11 is delimited by a lower wall 12 or bottom that is substantially flat and disposed in a plane XY containing the longitudinal axis X and the transverse axis Y, two side walls 13, a front wall 14 and a rear wall 15. Said side walls 13, front wall 14 and rear wall 15 form a substantially square or rectangular contour. Other, regular or irregular, contour shapes are also possible, in particular circular, polygonal or elongate shapes.

As illustrated in FIG. 3, the lower wall 12 of the receptacle has a thickness e1 of between 0.5 mm and 0.9 mm, for example equal to 0.7 mm.

As illustrated in FIG. 3, the peripheral wall of the receptacle 10, formed by the side walls 13, the front wall 14 and the rear wall 15, has a thickness e2 of between 0.75 mm and 0.85 mm, for example equal to 0.82 mm.

The lid 20 is mounted on the receptacle 10, in particular on the rear portion 15, by means of a hinge comprising the same rotary pin 16, parallel to the longitudinal axis X. The lid 20 comprises an internal volume 21 delimited by an upper wall 22, two side walls 23, a front wall 24 and a rear wall 25.

The rear wall 25 of the lid is rotatably mounted on said rotary pin 16.

The front wall 24 of the lid 20 comprises a retaining member 26 protruding in the continuation of said front wall, along the vertical axis Z in the closing position of the lid. The retaining member 26 is intended to cooperate, for example by snap-fitting, with a corresponding retaining member 17 of the receptacle 10, in order to retain the lid on said receptacle in the closing position of said lid.

Figure 1:
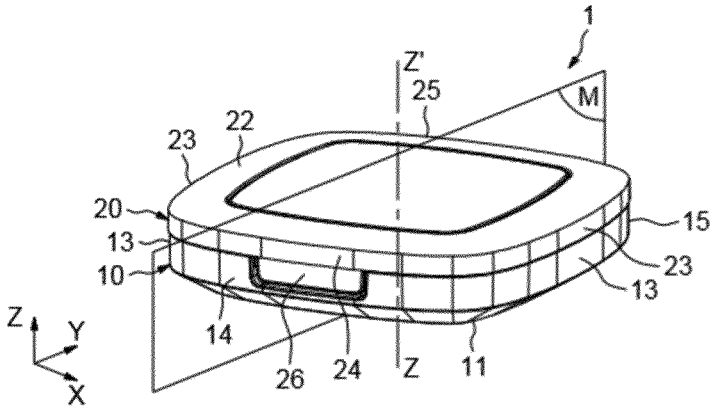
FIG. 1 shows a perspective view of a product packaging device according to one embodiment of the invention, in a closed configuration.

The lid 20 is movable between a closing position, shown in FIGS. 1 and 2, in which the lid 20 cooperates with the receptacle 10 and closes off access to the internal cavity 11, and an opening position, shown in FIG. 3, in which the lid 20 is pivoted away from the receptacle about the pin 16 to allow access to the internal volume 11.

In the closing position, the lid 20 is disposed above the receptacle 10.

The support member 30 is mounted in the internal cavity 11 of the receptacle 10 and forms a removable insert or refill so as to be replaced once used up or in order to change the cosmetic product.

Since the support member 30 is separate from the receptacle 10, it is possible to use two different materials, namely a first material for the receptacle 10 and a second material for the support member 30. The second material has a quality lower than the quality of the material of the receptacle 10. Thus, the second material can have a density and thus a price lower than those of the first material, making it possible to obtain a support member that is less expensive and lighter than the receptacle 10. The support member 30 comprises an internal volume 31 for receiving a cosmetic product 40, for example contained in a dish. As illustrated, the dish 40 comprises a single compartment of cosmetic product. As a variant, a dish having a plurality of compartments that each contain a cosmetic product could be provided. Provision could also be made for the cosmetic product(s) to be contained directly in the support member 30.

The internal volume 31 is delimited by a bottom wall 32 and a peripheral wall 33 forming a closed contour.

The support member 30 comprises an upper rim or bearing flange 34 protruding radially from the upper surface of the peripheral wall 33. The upper rim 34 is intended to be mounted inside the internal cavity 11 of the receptacle 10.

In an entirely non-limiting manner, the bottom wall 32 comprises a central extrusion or protrusion 32*a* extending from the upper surface of the bottom wall 32 towards the dish 40. This extrusion is generally created during the moulding, for example injection-moulding, of the material for forming the support member 30.

As illustrated, and in an entirely non-limiting manner, the dish 40 is fixed to the bottom wall 32 of the support member 30 by adhesive bonding, for example by a film of adhesive 35 disposed on the central protrusion 32*a*.

As illustrated, the bottom wall 32 of the support member 30 comprises a thickness e3 of between 0.65 mm and 0.75 mm, for example equal to 0.7 mm.

The support member 30 also comprises positioning ribs 36 protruding along the vertical axis Z from the lower surface of the rim 34 towards the receptacle 10.

Figure 6:
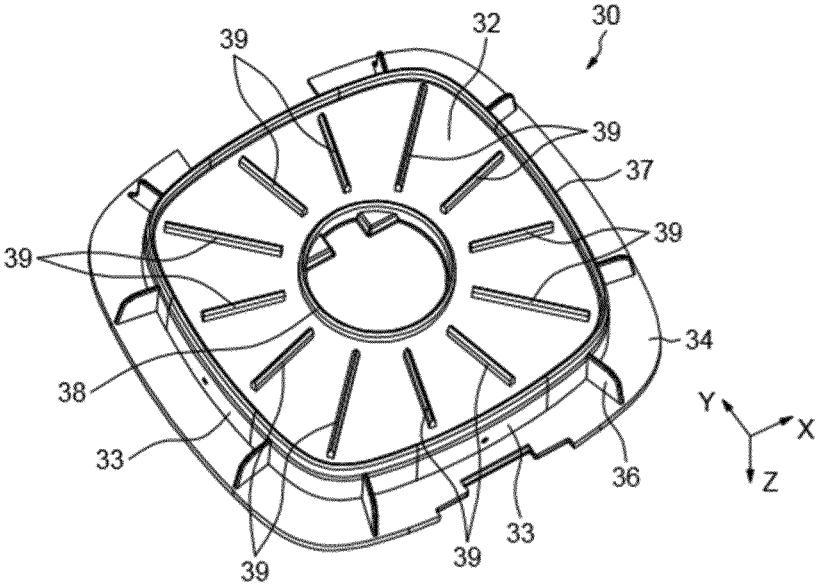
FIG. 6 is a perspective view of the support member of the device in FIG. 1.
Figure 7:
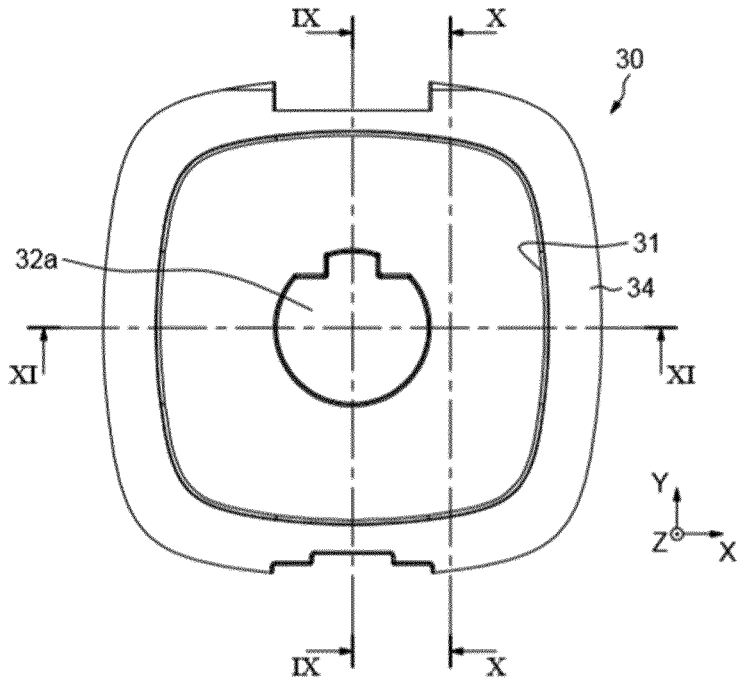
FIG. 7 shows a top view of the support member in FIG. 5.
Figure 8:
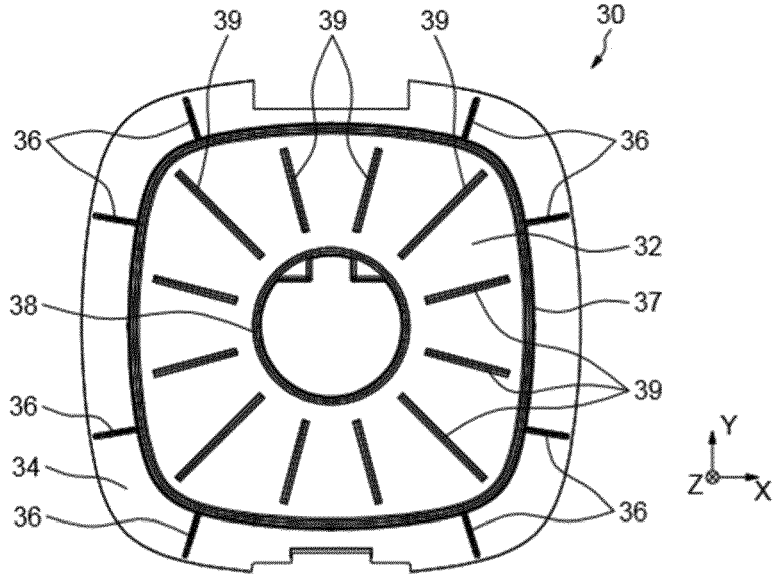
FIG. 8 shows a top view of the support member in FIG. 6.
Figure 9:
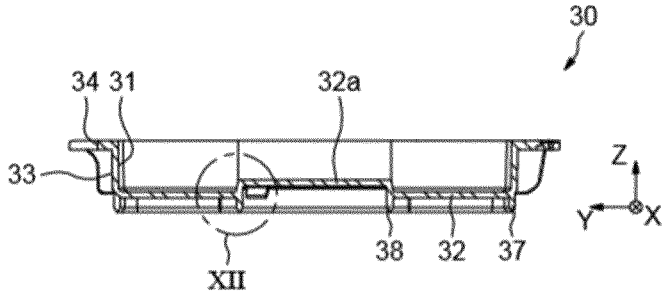
FIG. 9 illustrates a view in cross section on the axis IX-IX in FIG. 7.
Figure 10:
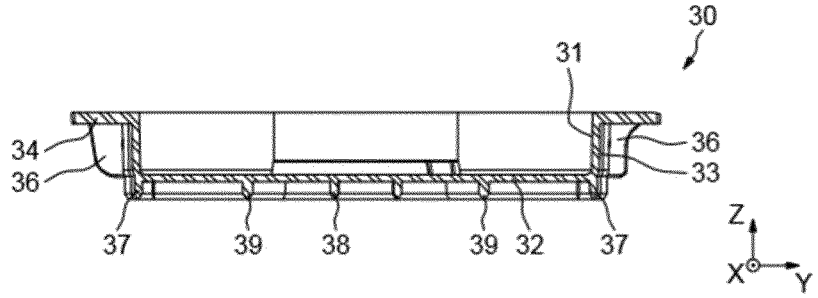
FIG. 10 illustrates a view in cross section on the axis X-X in FIG. 7.
Figure 11:
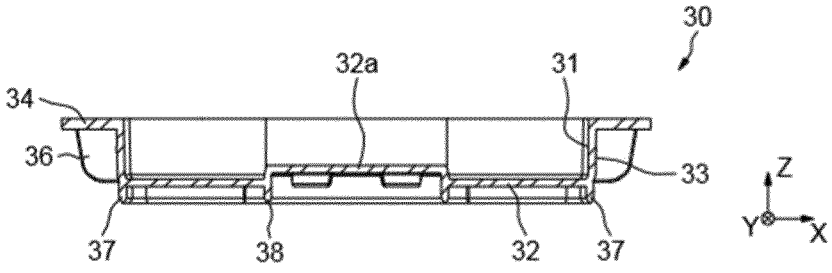
FIG. 11 illustrates a view in cross section on the axis XI-XI in FIG. 7.
Figure 12:
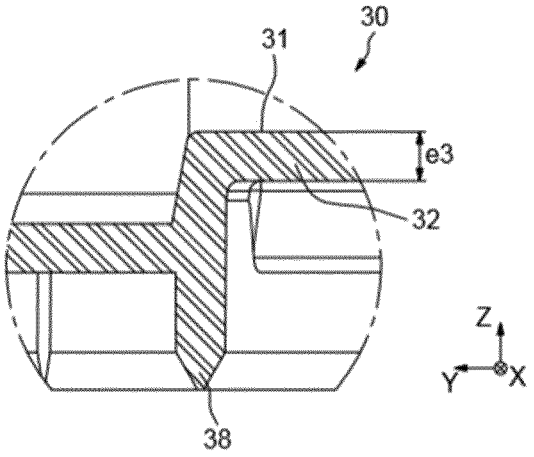
FIG. 12 is a detail view of FIG. 9.

As can be seen in detail in FIGS. 6 and 8, the support member 30 comprises a peripheral protrusion 37 extending along the vertical axis Z in the continuation of the peripheral wall 33 towards the lower wall 12 of the receptacle 10. The lower end of said peripheral protrusion 37 is mechanically fixed or secured to the upper surface of the lower wall 12 of the receptacle, for example by ultrasonic welding.

As a variant, the peripheral protrusion could be part of the receptacle 10 and extend along the elevation axis towards the support member 30.

The support member 30 also comprises a first central protrusion 38 with a closed contour extending along the vertical axis Z from the lower surface of the bottom wall 32 of the support member 30 towards the upper surface of the lower wall 12 of the receptacle. The lower end of said first central protrusion 38 is mechanically fixed to the upper surface of the lower wall 12 of the receptacle, for example by ultrasonic welding. As a variant, a central protrusion with a non-closed contour could be provided.

The support member 30 also comprises a plurality of radial protrusions 39 disposed between the central protrusion 38 and the peripheral protrusion 37 and extending along the vertical axis Z from the lower surface of the bottom wall 32 of the support member 30 towards the upper surface of the lower wall 12 of the receptacle. The lower end of each of said radial protrusions 39 is mechanically fixed to the upper surface of the lower wall 12 of the receptacle, for example by ultrasonic welding. As illustrated, the radial protrusions 39 are spaced apart regularly around the central protrusion 38. As a variant, a different disposition of the radial protrusions around the central protrusion 38 could be provided. As illustrated, the number of radial protrusions 39 is equal to 12. As a variant, a different number of radial protrusions, for example more than two, could be provided. In an entirely non-limiting manner, four first radial protrusions have in this case the same dimension and four second radial protrusions have the same dimension but a dimension smaller than the first radial protrusions. As a variant, provision could be made for the radial protrusions all to have identical or different dimensions.

In the embodiment illustrated in particular in FIGS. 6 and 8, the radial protrusions 39 extend radially between the central protrusion 38 and the peripheral protrusion 37 without, however, being connected thereto, a space in the radial direction remaining between each end of the radial protrusion 39 and the central protrusion 38 on one side and the peripheral protrusion 37 on the other. Such a configuration may in particular be advantageous when the support member 30 is fixed in the receptacle 10 by ultrasonic welding, erratic behaviour of the material being liable to occur at the junction between the radial protrusions and the central protrusion 38 and/or the peripheral protrusion 37 during such a process if these were connected together.

As a variant, provision may be made for one, another, or all of the radial protrusions 39 to the joined in the radial direction to the central protrusion 38 and/or to the peripheral protrusion 37. Such a configuration may in particular be advantageous when the support member is fixed in the receptacle by adhesive bonding.

Only radial protrusions and no central protrusion or, as a variant, only a central protrusion and no radial protrusions could also be provided.

As a variant or in addition, provision could likewise be made for the central protrusion and/or one or more radial protrusions to be part of the receptacle 10 and to extend along the elevation axis towards the support member 30.

The peripheral protrusion 37, the central protrusion 38, the radial protrusions 39 and the support member form a single piece formed from a single material during a single moulding operation.

Figure 13:
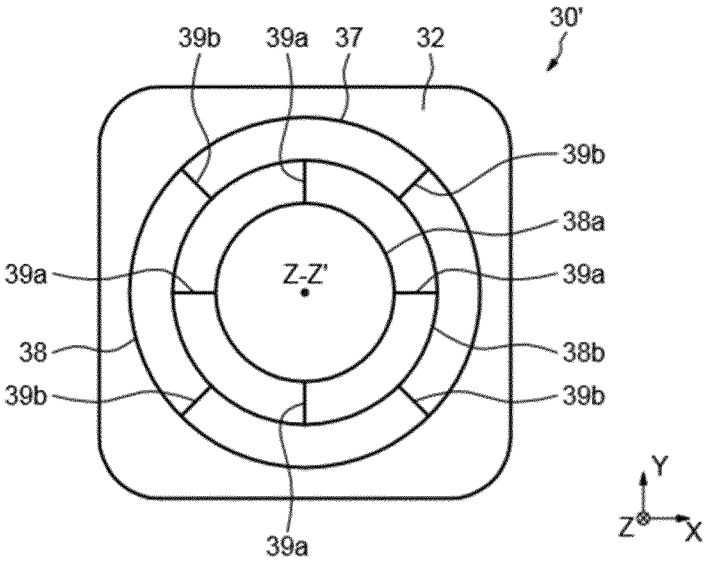

In the embodiment illustrated in FIG. 13, in which the same elements bear the same references, the support member 30' differs from the support member 30 illustrated in FIGS. 2 to 12 only by the shape and the disposition of the stiffening members.

As illustrated, the support member 30' comprises a peripheral protrusion 37 extending along the vertical axis Z in the continuation of the peripheral wall 33 towards the lower wall 12 of the receptacle 10. The lower end of said peripheral protrusion 37 is mechanically fixed to the upper surface of the lower wall 12 of the receptacle, for example by ultrasonic welding.

The support member 30' also comprises a central protrusion 38*a* and an intermediate protrusion 38*b* coaxial with the central protrusion 38*a*, both protrusions having a closed contour extending along the vertical axis Z from the lower surface of the bottom wall 32 of the support member 30 towards the upper surface of the lower wall 12 of the receptacle. The lower end of each of said central and intermediate protrusions 38*a*, 38*b* is mechanically fixed to the upper surface of the lower wall 12 of the receptacle, for example by ultrasonic welding. As a variant, provision could be made for the central protrusions not to have a closed contour. A different number of central protrusions, for example more than or equal to three, could also be provided.

The support member 30' also comprises a plurality of first radial protrusions 39*a* disposed between the first central protrusion 38*a* and the intermediate protrusion 39*b* and a plurality of second radial protrusions 39*b* disposed between the intermediate protrusion 38*b* and the peripheral protrusion 37. The radial protrusions 39*a*, 39*b* extend along the vertical axis Z from the lower surface of the bottom wall 32 of the support member 30' towards the upper surface of the lower wall 12 of the receptacle. The lower end of each of said radial protrusions 39*a*, 39*b* is mechanically fixed to the upper surface of the lower wall 12 of the receptacle, for example by ultrasonic welding. As illustrated, the radial protrusions 39*a*, 39*b* are spaced apart regularly around the corresponding central protrusion 38*a*, 38*a*. As a variant, a different disposition of the radial protrusions around the corresponding central or intermediate protrusion 38*a*, 38*b* could be provided. As illustrated, the number of first radial protrusions 39*a* is equal to four and the number of second radial protrusions 39*b* is equal to four. As a variant, a different number of radial protrusions, for example more than two, could be provided. In an entirely non-limiting manner, the radial protrusions in this case have the same dimension. As a variant, provision could be made for the radial protrusions all to have identical or different dimensions.

The peripheral protrusion 37, the central protrusion 38*a*, the intermediate protrusion 38*b*, the radial protrusions 39*a*, 39*b* and the support member 30' form a single piece formed from a single material during a single moulding operation.

In the embodiment illustrated in FIG. 14, in which the same elements bear the same references, the support member 30" differs from the support member 30 illustrated in FIGS. 2 to 12 only by the shape and the disposition of the stiffening members.

As illustrated, the support member 30" comprises a peripheral protrusion 37 extending along the vertical axis Z in the continuation of the peripheral wall 33 towards the lower wall 12 of the receptacle 10. The lower end of said peripheral protrusion 37 is mechanically fixed to the upper surface of the lower wall 12 of the receptacle, for example by ultrasonic welding.

The support member 30" also comprises a central protrusion 38 with a closed contour extending along the vertical axis Z from the lower surface of the bottom wall 32 of the support member 30" towards the upper surface of the lower wall 12 of the receptacle. The lower end of the central protrusion 38 is mechanically fixed to the upper surface of the lower wall 12 of the receptacle, for example by ultrasonic welding. As a variant, provision could be made for the central protrusion not to have a closed contour. A different number of central protrusions, for example more than or equal to two, could also be provided.

The support member 30" also comprises an intermediate protrusion 40 with a closed contour that surrounds the central protrusion 38, extends along the vertical axis Z from the lower surface of the bottom wall 32 of the support member 30" towards the upper surface of the lower wall 12 of the receptacle and is mechanically fixed to the upper surface of the lower wall 12 of the receptacle, for example by ultrasonic welding. As illustrated, the intermediate protrusion 40 has a polygonal shape.

The support member 30" also comprises a plurality of radial protrusions 39 with a closed contour that are disposed between the intermediate protrusion 40 and the peripheral protrusion 37. The radial protrusions 39 extend along the vertical axis Z from the lower surface of the bottom wall 32 of the support member 30" towards the upper surface of the lower wall 12 of the receptacle. The lower end of each of said radial protrusions 39 is mechanically fixed to the upper surface of the lower wall 12 of the receptacle, for example by ultrasonic welding. As illustrated, the radial protrusions 39 are spaced apart regularly around the corresponding central protrusion 38.

In the exemplary embodiment illustrated in FIG. 14, the radial protrusions 39 have a closed contour, being connected to the intermediate protrusion 40. The radial protrusions 39 are in this case substantially U-shaped, with the free ends of the legs of the U being connected together via a portion of the intermediate protrusion 40, thereby forming a closed contour.

As a variant, provision could be made for the radial protrusions 39 to be substantially U-shaped, with the free ends of the legs of the U not being connected together, the radial protrusions 39 then forming a non-closed contour.

The peripheral protrusion 37, the central protrusion 38, the radial protrusions 39, the intermediate protrusion 40 and the support member 30" form a single piece formed from a single material during a single moulding operation.

In a general manner, the case 1 comprises a stiffening member formed by at least one protrusion that extends along the vertical axis Z from the bottom wall of the support member towards the lower wall of the receptacle and is mechanically fixed to said lower wall in order to form mechanical connections between said support member and said receptacle.

By virtue of the invention, and in particular of the stiffening ribs, it is possible to significantly reduce the wall thicknesses of the receptacle and of the support member and thus the weight of the product packaging device as a whole.

The invention claimed is:

1. A device for packaging a product, in particular a cosmetic product, comprising:

a receptacle extending along an elevation axis and comprising an internal volume delimited by a lower wall and a peripheral wall;

a lid that is hinged with respect to said receptacle between a closing position, in which said lid cooperates with the receptacle and closes off access to the internal volume of said receptacle, and an opening position, in which said lid is pivoted away from the receptacle to allow access to said internal volume; and a support member that is mounted in the internal cavity of the receptacle and is intended to receive at least one cosmetic product, the support member comprising an internal volume delimited by a bottom wall and a peripheral wall, wherein one of the support member or the receptacle comprises at least one stiffening member that extends along the elevation axis towards the other of the receptacle or the support member and is secured to the other of the receptacle or the support member, wherein one of the support member or the receptacle comprises an at least partially peripheral protrusion that extends along the elevation axis towards the other of the receptacle or the support member and is secured to the other of the receptacle or the support member, the stiffening member being surrounded by said peripheral protrusion, wherein the stiffening member is fixed to the receptacle or to the support member by ultrasonic welding.

2. The device according to claim 1, wherein the support member comprises the at least partially peripheral protrusion that extends along the elevation axis in the continuation of the peripheral wall towards the lower wall of the receptacle and is secured to said lower wall, and the stiffening member that extends along the elevation axis from the bottom wall of the support member towards the lower wall of the receptacle and is secured to said lower wall.

3. The device according to claim 2, wherein the stiffening member and/or the peripheral protrusion is/are formed integrally with the support member.

4. The device according claim 1, wherein the stiffening member comprises at least one central protrusion surrounded by the peripheral protrusion.

5. The device according to claim 4, wherein the central protrusion has a closed contour.

6. The device according to claim 1, wherein the stiffening member comprises at least one radial protrusion extending radially compared to the elevation axis.

7. The device according to claim 4, wherein the radial protrusion is disposed between the central protrusion and the peripheral protrusion.

8. The device according to claim 7, wherein the stiffening member comprises at least one intermediate protrusion disposed between the central protrusion and the peripheral protrusion.

9. The device according to claim 8, comprising at least one radial protrusion between the central protrusion and the intermediate protrusion.

10. The device according to claim 8, comprising at least one radial protrusion between the intermediate protrusion and the peripheral protrusion.

11. The device according to claim 8, wherein the intermediate protrusion is concentric with the central protrusion.

12. The device according to claim 8, wherein the intermediate protrusion has a closed contour.

13. The device according to claim 1, wherein the lower wall of the receptacle has a thickness of between 0.5 mm and 0.9 mm.

14. The device according to claim 1, wherein the bottom wall of the support member has a thickness of between 0.65 mm and 0.75 mm.

15. A device for packaging a product, in particular a cosmetic product, comprising:

a receptacle extending along an elevation axis and comprising an internal volume delimited by a lower wall and a peripheral wall;

a lid that is hinged with respect to said receptacle between a closing position, in which said lid cooperates with the receptacle and closes off access to the internal volume of said receptacle, and an opening position, in which said lid is pivoted away from the receptacle to allow access to said internal volume; and a support member that is mounted in the internal cavity of the receptacle and is intended to receive at least one cosmetic product, the support member comprising an internal volume delimited by a bottom wall and a peripheral wall, wherein one of the support member or the receptacle comprises at least one stiffening member that extends along the elevation axis towards the other of the receptacle or the support member and is secured to the other of the receptacle or the support member, wherein one of the support member or the receptacle comprises an at least partially peripheral protrusion that extends along the elevation axis towards the other of the receptacle or the support member and is secured to the other of the receptacle or the support member, the stiffening member being surrounded by said peripheral protrusion, wherein a permanent mechanical connection is provided between the receptacle and the support member.

16. A device for packaging a product, in particular a cosmetic product, comprising:

a receptacle extending along an elevation axis and comprising an internal volume delimited by a lower wall and a peripheral wall;

a lid that is hinged with respect to said receptacle between a closing position, in which said lid cooperates with the receptacle and closes off access to the internal volume of said receptacle, and an opening position, in which said lid is pivoted away from the receptacle to allow access to said internal volume; and a support member that is mounted in the internal cavity of the receptacle and is intended to receive at least one cosmetic product, the support member comprising an internal volume delimited by a bottom wall and a peripheral wall, wherein the support member comprises at least one stiffening member that extends along the elevation axis from the bottom wall towards the receptacle and is secured to the receptacle, wherein the support member comprises an at least partially peripheral protrusion that extends along the elevation axis in the continuation of the peripheral wall towards the receptacle and is secured to the receptacle, the stiffening member being surrounded by said peripheral protrusion, wherein the stiffening member and the partially peripheral protrusion extend axially on the side opposite to the internal volume of the support member.

* * * * *